US010258164B2

(12) United States Patent
Shi

(10) Patent No.: US 10,258,164 B2
(45) Date of Patent: Apr. 16, 2019

(54) MATTRESS CORE WITH REPLACEABLE INNER BLOCKS

(71) Applicant: Lei Shi, Luoyang (CN)

(72) Inventor: Lei Shi, Luoyang (CN)

(73) Assignee: Lei Shi, Luoyang (CN)

( * ) Notice: Subject to any disclaimer, the term of this patent is extended or adjusted under 35 U.S.C. 154(b) by 0 days.

(21) Appl. No.: 14/939,429

(22) Filed: Nov. 12, 2015

(65) Prior Publication Data

US 2017/0007035 A1 Jan. 12, 2017

(30) Foreign Application Priority Data

Jul. 9, 2015 (CN) ..... 2015 2 0489490 U

(51) Int. Cl.

| | |
|---|---|
| ***A47C 27/00*** | (2006.01) |
| ***A47C 27/15*** | (2006.01) |
| ***A47C 27/06*** | (2006.01) |
| ***A47C 27/14*** | (2006.01) |
| ***A47C 27/22*** | (2006.01) |

(52) U.S. Cl.

CPC ..... *A47C 27/001* (2013.01); *A47C 27/06* (2013.01); *A47C 27/144* (2013.01); *A47C 27/15* (2013.01); *A47C 27/22* (2013.01)

(58) Field of Classification Search

CPC ..... A47C 27/00; A47C 27/001; A47C 27/05; A47C 27/056; A47C 27/121; A47C 27/14; A47C 27/142; A47C 27/143; A47C 27/144; A47C 27/148; A47C 27/15; A47C 27/18; A47C 27/22; A47C 27/06

See application file for complete search history.

(56) References Cited

U.S. PATENT DOCUMENTS

| | | | | |
|---|---|---|---|---|
| 3,146,469 | A * | 9/1964 | Slade | A47C 27/144 5/695 |
| 5,279,009 | A | 1/1994 | Putka | |
| 5,953,779 | A * | 9/1999 | Schwartz | A47C 27/001 5/692 |
| 6,397,419 | B1 * | 6/2002 | Mechache | A47C 27/082 5/710 |
| 2003/0221262 | A1 * | 12/2003 | Torbet | A47C 27/082 5/713 |
| 2015/0082550 | A1 * | 3/2015 | Hui | A47C 27/001 5/727 |

* cited by examiner

*Primary Examiner* — Nicholas F Polito
(74) *Attorney, Agent, or Firm* — Timothy T. Wang; Ni, Wang & Massand, PLLC

(57) ABSTRACT

A mattress core with replaceable inner blocks includes a base, an open slot A located in the upper portion of the base, an open slot B located in the lower portion of the base, an inner block located within slot B and shaped to partially fill up slot B with the remaining space forming a groove in slot B, a strip-shaped inner block made of soft material and fit into the groove, and a cover plate configured to fit in said slot A.

5 Claims, 4 Drawing Sheets

MATTRESS CORE WITH REPLACEABLE INNER BLOCKS

BACKGROUND OF THE INVENTION

Field of the Invention

The instant disclosure is generally related to mattress cores and more specifically to a mattress core with replaceable inner blocks.

People generally spend one third of their time in bed. Along with improvements in living condition, we expect better quality of life. Therefore, the mattress, as the most important part of a bed and directly contacts with the human body, plays a critical role for human's healthy sleep. A conventional mattress purchased and/or used by a consumer includes an internal structure that typically cannot be changed. As a result, integrated traditional mattress cannot meet the diverse needs of different users. During sleep, a person typically sleeps sideways for half of their sleep period. But in a sideway sleep position, because the human shoulder is broader than other parts of body, it takes more pressure. This higher pressure to the arm placed against the mattress often leads to numbness and stiffness. Customers suffer discomfort or even illness because of this. When two persons are hugging one of the other for sleep, it often causes pain, numbness or stiffness to the one who is holding the other because he or she has to cross his or her arms underneath the other and remain pressed by the other for a long period of time.

SUMMARY

In order to overcome the deficiencies of the prior art, the present disclosure provides a mattress core with replaceable inner blocks. It converts the traditionally integrated mattress core into multiple modular blocks so that the inner blocks can be replaced as needed. Further the present inventions provide an inner module design with a groove, which is suitable for placing in arm through. The groove, which allows for placement of the shoulder and arm lying against the bed, allows for more even weight distribution, rather than placing a disproportionate amount of weight on the arm and shoulder against the bed. It reduces the pressure. The holding person will no longer feel uncomfortableness, stiffness or numbness.

A preferred embodiment of the present inventions includes a base, an open slot A located in the upper portion of the base, an open slot B located in the lower portion of the base, an inner block located within slot B and shaped to partially fill up slot B with the remaining space forming a groove in slot B, and a cover plate configured to fit in said slot A.

The inner block is made of at least one piece.

The inner block is further a replaceable inner block, made of sponge, spring, or palm.

Another preferred embodiment of the present inventions further comprises a strip-shaped inner block in said groove.

The strip-shaped inner block is made of soft material.

The cover plate in a preferred embodiment matches the shape of said slot A, and said inner block in said slot B is in close contact with said strip-shaped inner block and the combination of the inner block and strip-shaped inner block matches the shape of said slot B.

The horizontal length and width of said slot A is larger or equal to the horizontal length and width of said slot B.

The inner block in a preferred embodiment is made of a first half block and a second half block and said first and second half blocks are in close contact with each other; and the base is made of a first half base and a second half base and includes two half base: first half base and second half base said first and second bases are in close contact with each other.

The material for said first half block can be the same or different from the material for said inner half block.

A technical advantage of the present inventions is splitting a traditionally integrated mattress core into a plurality of modules. So that the inner core can be replaced as needed. The model provides a groove, suitable for laying an arm inside. By adopting the present inventions, when someone is laying one side, his shoulder and arms won't be pressured by the weight of his or her body. When two persons are holding each other while lying in the bed, the shoulder and arm of the person holding, the other will no longer be pressed by the weight of the other. It reduces the pressure. The holding person will no longer feel uncomfortableness, stiffness or numbness. Therefore, the advantages of the present inventions include the benefit of replaceable inner blocks. It provides a comfortable solution for laying the arms in the groove while one person sleeping sideway or holding another person. The solutions disclosed herein are practical and beneficial. It has great potential for the consumer market.

Figure 1:
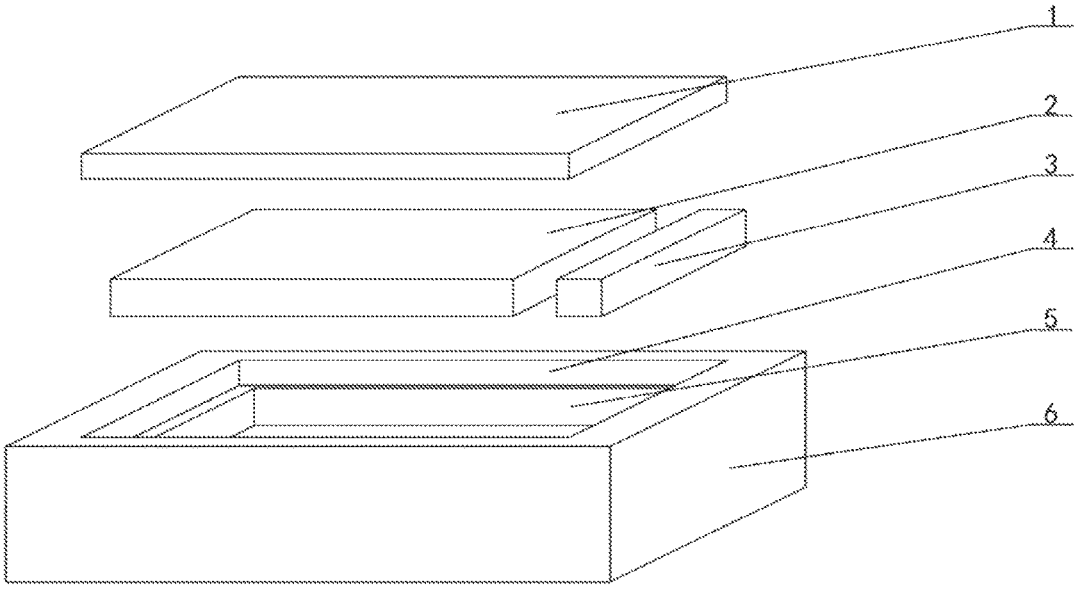
FIG. 1 depicts a structural diagram of a preferred embodiment.

The depicted figures include: 1—Cover plate; 2—Inner block; 3—Strip-shaped inner block; 4—Slot A; 5—Slot B; 6—Base; 7—Groove; 8—First half block; 9—Second half block; 10—First half-base; 11—Second half base.

DETAILED DESCRIPTION

FIG. 1-5 shows two preferred embodiments of a mattress core with replaceable inner blocks. It include a base 6, a slot A 4 is located in the upper portion of the base 6, a slot B 5 is located under slot A in the lower portion of the base 6. An inner block 2 is located within the slot B 5. There may be one or more inner blocks 2 in slot B 5. Inner block 2 can be made of sponge, spring, or palm. The space between the inner block 2 and the slot B 5 forms a groove 7. A strip-shaped inner block 3 is placed in the groove 7. The strip-shaped inner block 3 is made of soft material. A cover plate 1 is placed in slot A 4. The cover plate 1 matches and fill up slot A 4. The inner block 2 is in close contact with the strip-shaped inner block 3. Both the inner block 2 and the strip-shaped inner block 3 are located within slot B 5, and the combination of both matches and fill up the space in slot B 5. The horizontal length and width of said slot A are larger or equal to the horizontal length and width of said slot B. The inner block 2 can be made of two half blocks, i.e., first half block 8 and second half block 9. The first block 8 and second block 9 are in close contact with each other. The material for the first half block 8 may be the same or different with the material of the second half block 9. The base 6 can includes two half bases, i.e., first half base 10 and second half base 11.

Figure 2:
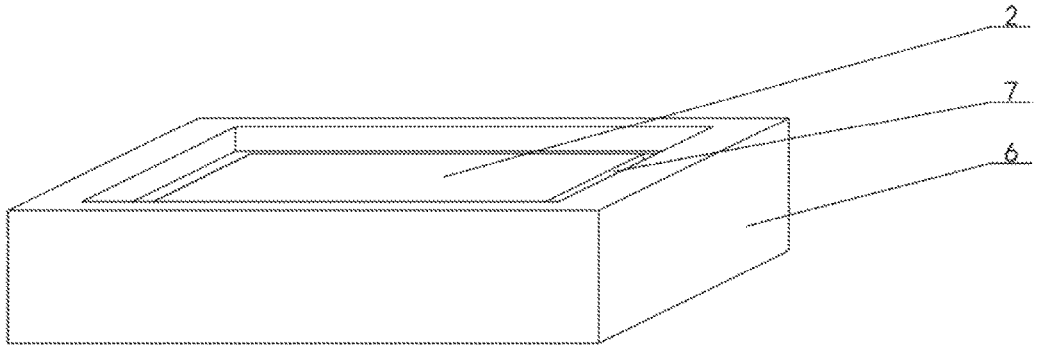
FIG. 2 depicts a structural diagram with the inner block in slot B.
Figure 3:
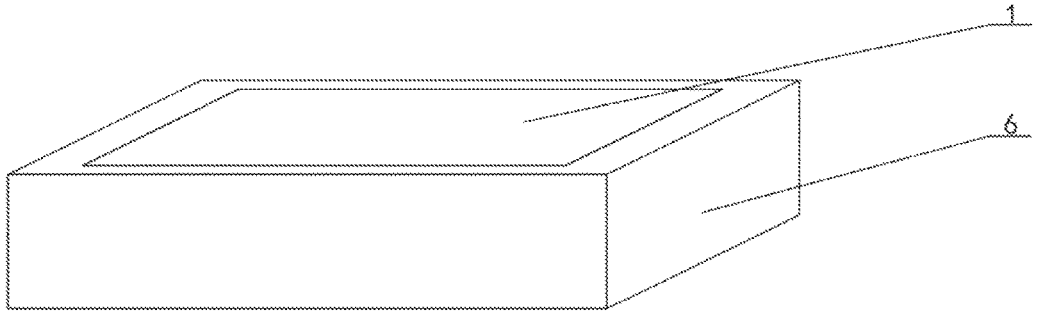
FIG. 3 depicts the structural diagram with the cover plate in slot A.

One preferred embodiment of present inventions are shown in FIGS. 1-3. It includes one inner block 2 used for a full or twin size bed. An inner block 2 is placed in slot B 5 within the base 6. A strip-shaped inner block is then placed into the groove 7, which is formed between the inner block 2 and the slot B 5. Finally a cover plate 1 fills up the slot A 4 within the base 6. It is then ready for use. The strip-shaped inner block 3 is made of soft material. Therefore when someone is laying on his or her side, his or her shoulder and arm can be wholly or partially placed into groove 7. It reduces the pressure against the shoulder and arm. When it is necessary to change the inner block 2, one may simply take out cover plate 1, take out the inner block 102, place a new inner core block 2 into original position, and then put the cover plate 1 back in.

Figure 4:
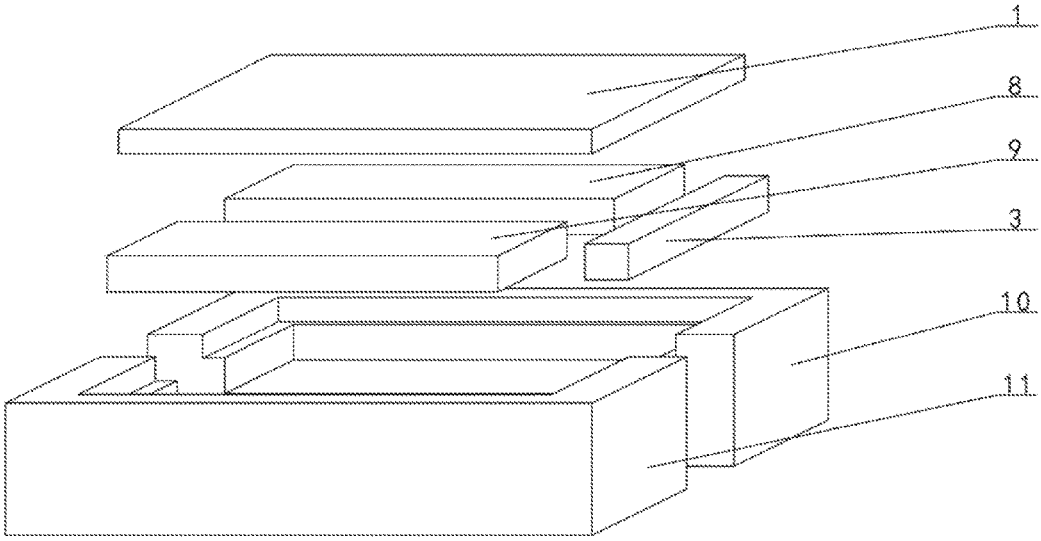
FIG. 4 depicts the structural diagram of another preferred embodiment.
Figure 5:
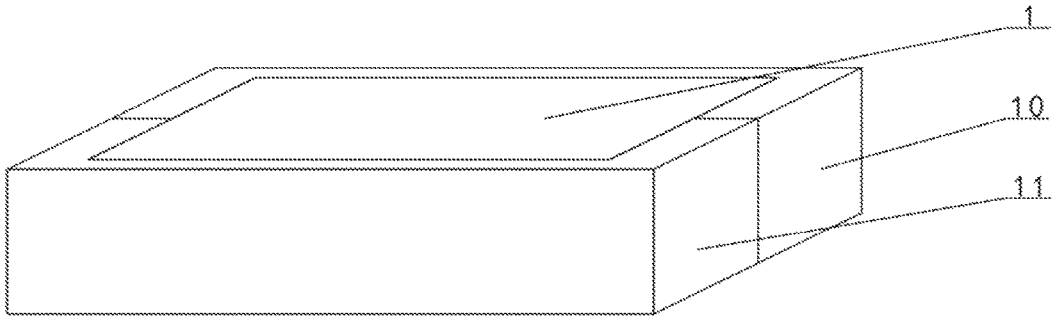
FIG. 5 depicts the overall structure of the preferred embodiment when fully integrated.

FIGS. 4-5 show yet another preferred embodiment of the present inventions. When bed is a double, queen or king size, the mattress may include a first half base 10 and a second half base 11, which together forms an integrated base. A first half inner block 8 and a second half inner block 9 are placed in slot B 5 formed by first half base 10 and second half base 11. A strip-shaped core block 3 is placed in the groove 7, which is the space between slot B 5 and first half inner block 8 and second half inner block 9. A cover plate 1 is then set in slot A 4, which is formed by first half base 10 and second half base 11. The mattress is then ready for use. Because the strip-shaped inner block 3 is made of soft material when someone is laying on his or her side, his or her shoulder and arm can be wholly or partially placed into groove 7. This reduces the pressure against the shoulder and arm. When a person is laying in another's arms, the holding person's arm can be placed underneath the other's body into the groove. It reduces the pressure on the holding person's arm and shoulder. Further it avoids the feeling or numbness and stiffness for the holding person. It minimize any discomfort that may occur. When it is necessary to change the first half inner block 8 and/or the second half inner block 9, one can simply take out the cover plate 1, take out first half block 8 and/or second half block 9, put a new first half block 8 and/or second half block 9 into their respective original position, and then put the cover plate 1 back in.

Although an exemplary embodiment of the product of the present invention has been illustrated in the accompanied drawings and described in the foregoing detailed description, it will be understood that the invention is not limited to the embodiments disclosed, but is capable of numerous rearrangements, modifications, and substitutions without departing from the spirit of the invention as set forth and defined by the following claims. What the present invention does not disclose, is the prior art.

What is claimed is:

1. A mattress core comprising:

a base, the base having an open slot A located in an upper portion of the base and an open slot B located in a lower portion of the base, wherein at least one of a horizontal length of slot A and a width of slot A are larger than a horizontal length of slot B and a width of slot B respectively, and the horizontal length of slot B extends for a majority of a length of the base lower portion and the width of slot B extends for a majority of a width of the base lower portion;

a one piece inner block located within the base lower portion slot B and shaped as a rectangle block to fill in the majority of the base lower portion slot B with the base lower portion having a remaining space forming a groove within slot B, wherein the groove is shaped as a small rectangle block and accommodates a human arm and shoulder, and the inner block and the groove completely fill up slot B;

a one-piece strip-shaped inner block located within the base lower portion groove wherein the base lower portion is completely filled in by said inner block and strip-shaped inner block; and a cover plate complementary to the base upper portion slot A to completely fill in the base upper portion slot A.

2. The mattress core of claim 1 wherein the inner block is a replaceable inner block comprised of at least one of sponge, spring, and palm.

3. The mattress core of claim 1 wherein the strip-shaped inner block is comprised of compressible material.

4. The mattress core of claim 1 wherein the cover plate is complementary to slot A, and the inner block in slot B contacts the strip-shaped inner block and the combination of the inner block and the strip-shaped inner block is complementary to slot B.

5. The mattress core of claim 1 wherein one of the horizontal length of slot A and the width of slot A is equal to the horizontal length of slot B and the width of slot B respectively.

* * * * *